US009301046B1

(12) United States Patent
Das et al.

(10) Patent No.: US 9,301,046 B1
(45) Date of Patent: Mar. 29, 2016

(54) SYSTEMS AND METHODS FOR MINIMIZING DISTORTION IN AN AUDIO OUTPUT STAGE

(71) Applicant: Cirrus Logic, Inc., Austin, TX (US)

(72) Inventors: Tejasvi Das, Austin, TX (US); Xiaofan Fei, Austin, TX (US); Miao Song, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 271 days.

(21) Appl. No.: 14/039,662

(22) Filed: Sep. 27, 2013

(51) Int. Cl.
*H04R 3/00* (2006.01)

(52) U.S. Cl.
CPC ..... *H04R 3/00* (2013.01)

(58) Field of Classification Search
None
See application file for complete search history.

(56) References Cited

U.S. PATENT DOCUMENTS 4,648,113 A * 3/1987 Horn et al. ..... 381/1
6,154,548 A * 11/2000 Bizzan ..... 381/94.5
2006/0159292 A1* 7/2006 Guilbert ..... 381/120
2008/0013351 A1* 1/2008 Alexander ..... 363/123
2008/0175395 A1* 7/2008 Rice ..... 381/2
2009/0086984 A1* 4/2009 Coker et al. ..... 381/27
2010/0239102 A1* 9/2010 Miao et al. ..... 381/73.1
2010/0246858 A1* 9/2010 Enjalbert et al. ..... 381/120
2010/0264986 A1* 10/2010 Eschauzier et al. ..... 330/253
2013/0083951 A1* 4/2013 Majidzadeh Bafar et al. ..... 381/320
2013/0121505 A1* 5/2013 Duraiswami et al. ..... 381/92
2014/0355790 A1* 12/2014 Panov et al. ..... 381/120
2015/0016635 A1* 1/2015 Haas-Christensen et al. ..... 381/121

* cited by examiner

*Primary Examiner* — Peter Vincent Agustin
(74) *Attorney, Agent, or Firm* — Jackson Walker L.L.P.

(57) ABSTRACT

A control circuit coupled to a differential audio output stage may, responsive to a transition in a power supply voltage generated by a power supply, modify at least one of: (i) a first bandwidth associated with the power supply; (ii) a second bandwidth associated with a common-mode voltage generator for generating a desired output common-mode voltage based on the power supply voltage; and (iii) a third bandwidth associated with a common-mode feedback loop of the audio-output stage for setting an actual common-mode voltage at each of the pair of differential output terminals based on the desired output common-mode voltage; such that the second bandwidth is greater than or substantially equal to the first bandwidth during the transition and the third bandwidth is greater than or substantially equal to the second bandwidth during the transition.

21 Claims, 3 Drawing Sheets

SYSTEMS AND METHODS FOR MINIMIZING DISTORTION IN AN AUDIO OUTPUT STAGE

FIELD OF DISCLOSURE

The present disclosure relates in general to circuits for personal audio devices such as wireless telephones and media players, and more specifically, to systems and methods for minimizing or reducing distortion in an audio output stage in response to a change in a power supply voltage of the output stage.

BACKGROUND

Personal audio devices, including wireless telephones, such as mobile/cellular telephones, cordless telephones, mp3 players, and other consumer audio devices, are in widespread use. Such personal audio devices may include circuitry for driving a pair of headphones or one or more speakers. Such circuitry often includes a power amplifier for driving an audio output signal to headphones or speakers, and the power amplifier may often be the primary consumer of power in a personal audio device, and thus, may have the greatest effect on the battery life of the personal audio device. In devices having a linear power amplifier for the output stage, power is wasted during low signal level outputs, because the voltage drop across the active output transistor plus the output voltage will be equal to the constant power supply rail voltage. Therefore, amplifier topologies such as Class-G and Class-H are desirable for reducing the voltage drop across the output transistor(s) and thereby reducing the power wasted in dissipation by the output transistor(s).

In order to provide a changeable power supply voltage to such a power amplifier, a direct-current to direct-current power supply (e.g., a boost converter, buck converter, other power converter) or charge pump power supply may be used, such as that disclosed in U.S. patent application Ser. No. 11/610,496 (the "'496 Application"), in which an indication of the signal level at the output of the circuit is used to control the power supply voltage. The above-described topology may raise the efficiency of the audio amplifier, in general, as long as periods of low signal level are present in the audio source.

In embodiments in which the audio amplifier has a differential output stage, the power amplifier may suffer from clipping when the changeable power supply voltage changes from one voltage level to another. Such clipping may occur as circuitry for generating a common-mode voltage of the supply voltage to the audio amplifier (e.g., a common-mode voltage generator or a common-mode feedback loop) may not effectively track power supply voltage transitions, as such circuitry may be optimized in normal operation for high power supply rejection ratio and low power consumption, meaning such circuitry may slowly track the changing power supply voltage.

SUMMARY

In accordance with the teachings of the present disclosure, the disadvantages and problems associated with existing approaches to driving audio output signals may be reduced or eliminated.

In accordance with embodiments of the present disclosure, an audio amplifier circuit for providing a differential output signal to an audio transducer may include a power amplifier, a power supply, a common-mode voltage generator, a common-mode feedback loop, and a control circuit. The power amplifier may have an audio input for receiving a differential audio input signal, an audio output having a pair of differential output terminals for providing the differential output signal based on the differential audio input signal, and a power supply input. The power supply may provide a power supply voltage to the power supply input, wherein the power supply has a selectable operating mode selectable among a plurality of modes including at least a first operating mode and a second operating mode, wherein the power supply voltage is of a first magnitude in the first operating mode and is of a second magnitude in the second operating mode, and wherein the power supply voltage transitions between magnitudes associated with the plurality of modes in accordance with a first bandwidth. The common-mode voltage generator may generate a desired output common-mode voltage based on the power supply voltage, wherein the desired output common-mode voltage responds to the power supply voltage in accordance with a second bandwidth. The common-mode feedback loop may set an actual common-mode voltage at each of the pair of differential output terminals based on the desired output common-mode voltage, wherein the actual common-mode voltage responds to the desired common-mode voltage in accordance with a third bandwidth. The control circuit may, responsive to a transition of the power supply voltage due to a change between two of the plurality of modes, modify at least one of the first bandwidth, the second bandwidth, and the third bandwidth such that the second bandwidth is greater than or substantially equal to the first bandwidth during the transition and the third bandwidth is greater than or substantially equal to the second bandwidth during the transition.

In accordance with these and other embodiments of the present disclosure, a method for providing a differential output signal to an audio transducer, may include, responsive to a transition of a power supply voltage generated by a power supply for providing a power supply voltage to a power supply input of a power amplifier having an audio input for receiving a differential audio input signal, and an audio output having a pair of differential output terminals for providing the differential output signal based on the differential audio input signal, modifying at least one of: (i) a first bandwidth associated with the power supply, wherein the power supply has a selectable operating mode selectable among a plurality of modes including at least a first operating mode and a second operating mode, wherein the power supply voltage is of a first magnitude in the first operating mode and is of a second magnitude in the second operating mode, and wherein the power supply voltage transitions between magnitudes associated with the plurality of modes in accordance with the first bandwidth; (ii) a second bandwidth associated with a common-mode voltage generator for generating a desired output common-mode voltage based on the power supply voltage, wherein the desired output common-mode voltage responds to the power supply voltage in accordance with the second bandwidth; and (iii) a third bandwidth associated with a common-mode feedback loop for setting an actual common-mode voltage at each of the pair of differential output terminals based on the desired output common-mode voltage, wherein the actual common-mode voltage responds to the desired common-mode voltage in accordance with the third bandwidth; such that the second bandwidth is greater than or substantially equal to the first bandwidth during the transition and the third bandwidth is greater than or substantially equal to the second bandwidth during the transition.

In accordance with these and other embodiments of the present disclosure, a control circuit may be configured to, responsive to a transition of a power supply voltage generated by a power supply for providing a power supply voltage to a power supply input of a power amplifier having an audio input for receiving a differential audio input signal, and an audio output having a pair of differential output terminals for providing the differential output signal based on the differential audio input signal, modify at least one of: (i) a first bandwidth associated with the power supply, wherein the power supply has a selectable operating mode selectable among a plurality of modes including at least a first operating mode and a second operating mode, wherein the power supply voltage is of a first magnitude in the first operating mode and is of a second magnitude in the second operating mode, and wherein the power supply voltage transitions between magnitudes associated with the plurality of modes in accordance with the first bandwidth; (ii) a second bandwidth associated with a common-mode voltage generator for generating a desired output common-mode voltage based on the power supply voltage, wherein the desired output common-mode voltage responds to the power supply voltage in accordance with the second bandwidth; and (iii) a third bandwidth associated with a common-mode feedback loop for setting an actual common-mode voltage at each of the pair of differential output terminals based on the desired output common-mode voltage, wherein the actual common-mode voltage responds to the desired common-mode voltage in accordance with the third bandwidth; such that the second bandwidth is greater than or substantially equal to the first bandwidth during the transition and the third bandwidth is greater than or substantially equal to the second bandwidth during the transition.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
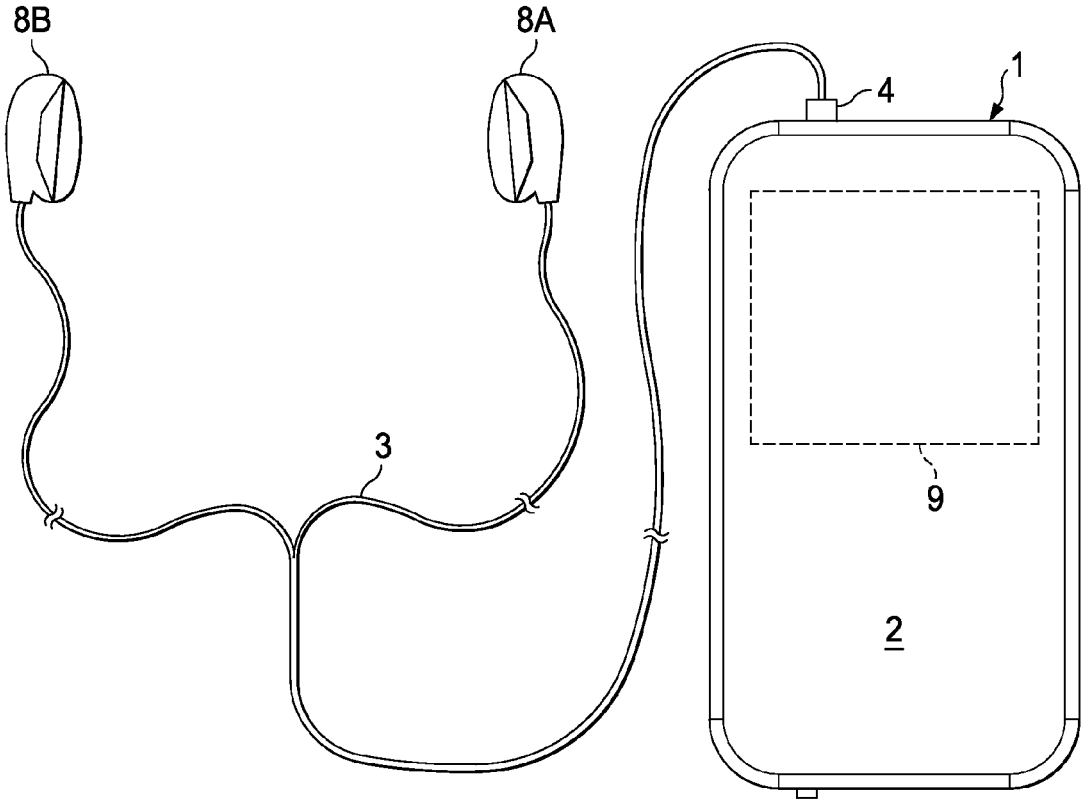
FIG. 1 is an illustration of an example personal audio device, in accordance with embodiments of the present disclosure.

FIG. 1 is an illustration of an example personal audio device 1, in accordance with embodiments of the present disclosure. FIG. 1 depicts personal audio device 1 coupled to a headset 3 in the form of a pair of earbud speakers 8A and 8B. Headset 3 depicted in FIG. 1 is merely an example, and it is understood that personal audio device 1 may be used in connection with a variety of audio transducers, including without limitation, headphones, earbuds, in-ear earphones, and external speakers. A plug 4 may provide for connection of headset 3 to an electrical terminal of personal audio device 1. Personal audio device 1 may provide a display to a user and receive user input using a touch screen 2, or alternatively, a standard LCD may be combined with various buttons, sliders, and/or dials disposed on the face and/or sides of personal audio device 1. As also shown in FIG. 1, personal audio device 1 may include an audio integrated circuit (IC) 9 for generating an analog audio signal for transmission to headset 3 and/or another audio transducer.

Figure 2:
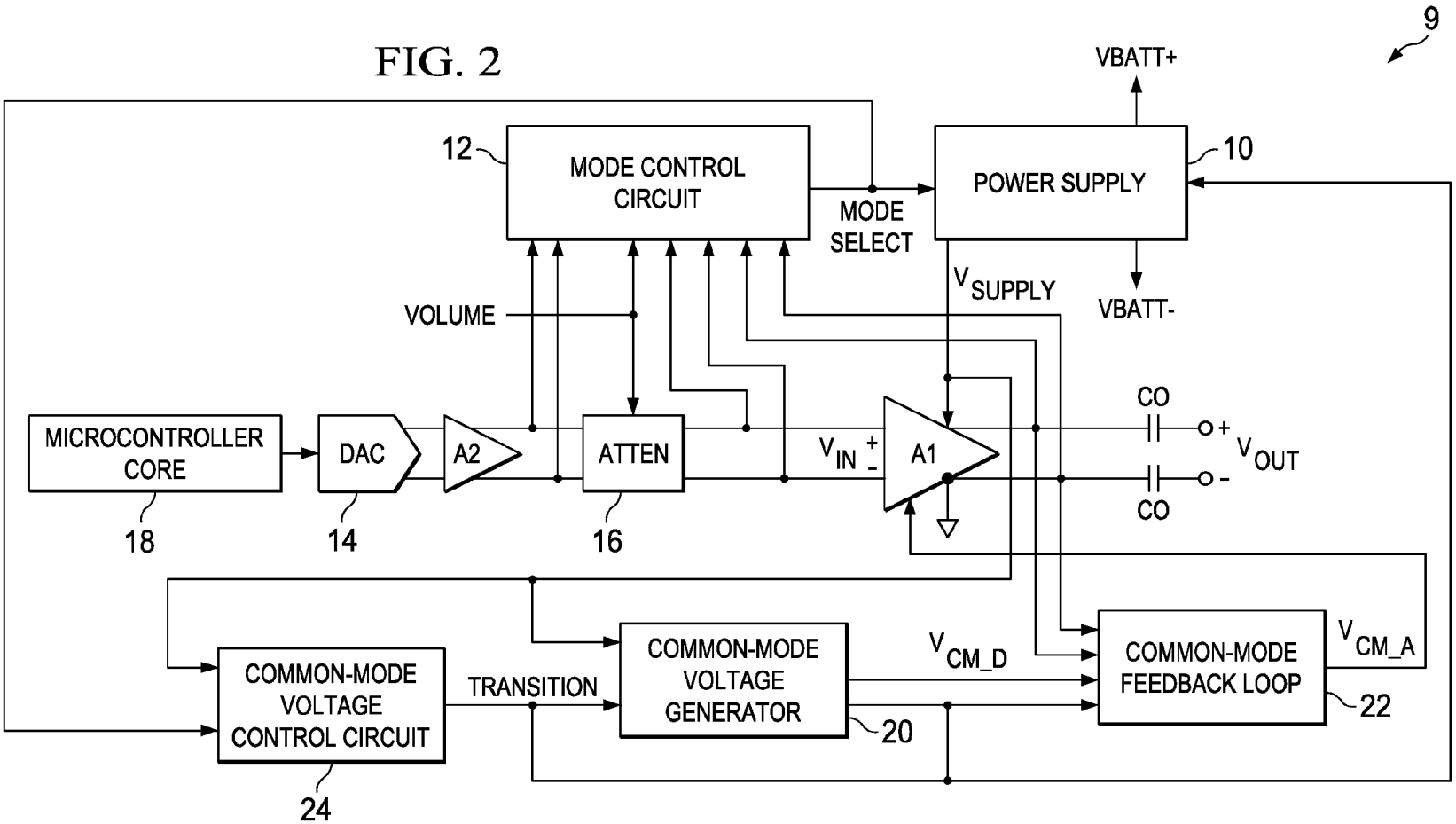
FIG. 2 is a block diagram of selected components of an example audio integrated circuit of a personal audio device, in accordance with embodiments of the present disclosure.

FIG. 2 is a block diagram of selected components of an example audio IC 9 of a personal audio device, in accordance with embodiments of the present disclosure. As shown in FIG. 2, a microcontroller core 18 may supply a digital audio input signal to a digital-to-analog converter (DAC) 14, which may in turn supply an analog audio input signal to a first amplifier stage A2 that may be operated from a fixed voltage power supply. In the embodiments represented by FIG. 2, the input to DAC 14 is a digital audio source, but that is not a limitation of the present disclosure, as the techniques of the present disclosure may be applied to an audio amplifier having a purely analog signal path. The signal at the output of first amplifier stage A2 may be provided to an attenuator 16 that receives a volume control signal and attenuates the signal accordingly. Attenuator 16 may be a digital potentiometer having control provided from a microcontroller or other digital control circuit responsive to a user interface, volume knob encoder or program command, or attenuator 16 may be an analog potentiometer that provides the volume control signal as an output indication from a secondary deck (a separate potentiometer circuit coupled to the common shaft or other mechanism) for use in the power supply control algorithms described in the '496 Application, which is incorporated by reference herein. While an attenuator 16 is shown as the volume control mechanism, it is understood that an equivalent volume control may be provided by a programmable resistor or adjustable gain in the feedback of amplifier A2 or another amplifier stage in the signal path. A final power amplifier stage A1 may amplify the audio input signal $V_{IN}$ received from attenuator 16 and provide a differential audio output signal \$T_{OUT}$, which may operate a speaker, headphone transducer, and/or a line level signal output. Capacitors CO may be utilized to couple the output signal to the transducer or line level output, particularly if a different output common-mode level than that provided by amplifier A1 is desired.

In the embodiments represented by FIG. 2, the signal path from DAC 14 through amplifier A1 is shown comprising fully differential signals. However, in some embodiments, one or more of the signals within the signal path other than the audio output signal \$T_{OUT}$ may be single-ended signals (e.g., referenced to a ground voltage).

A power supply 10 (e.g., a power supply or direct-current ("DC") to direct-current ("DC") power converter) may provide the power supply rail inputs of amplifier A1 and may receive a power supply input, generally from a battery or other power supply, depicted as battery terminal connections VBATT+ and VBATT−. A mode control circuit 12 may supply a Mode Select signal to power supply 10 that selects an operating mode of power supply 10 as described in greater detail in the '496 Application. Also, output voltage $V_{SUPPLY}$ of power supply 10 may be adjusted according to expected and/or actual audio signal levels at the amplifier output according to the techniques disclosed elsewhere in this disclosure and/or in the '496 Application.

When low signal levels exist and/or are expected at amplifier output $V_{OUT}$, the power efficiency of the audio output stage may be improved by varying the supply voltage $V_{SUPPLY}$ in conformity with the output signal $V_{OUT}$ or a signal (e.g., volume control signal Volume, audio input signal $V_{IN}$) indicative of the output signal $V_{OUT}$. In order to determine the actual and/or expected signal amplitudes at the output of amplifier A1, the volume control signal Volume, audio output signal $V_{OUT}$, and/or audio input signal $V_{IN}$ may be supplied to mode control circuit 12 for controlling the power supply $V_{SUPPLY}$ generated by power supply 10, in conformity with the expected amplitude of the output signal. When power supply 10 transitions between modes and accordingly transitions the power supply voltage $V_{SUPPLY}$ between two magnitudes, such transition may take place at a first bandwidth, wherein the first bandwidth defines a speed of response of power supply voltage $V_{SUPPLY}$ to a change in the operating mode of power supply 10.

To appropriately generate a differential audio output signal $V_{OUT}$, amplifier A1 may require reference to a common-mode voltage $V_{CM_A}$ approximately equal to the average of the amplitude of differential audio output signal $V_{OUT}$. To set the common-mode voltage $V_{CM_A}$ to a desired level, a common-mode voltage generator 20 may generate a desired output common-mode voltage $V_{CM_D}$ based on power supply voltage $V_{SUPPLY}$. In steady-state operation (e.g., when power supply voltage $V_{SUPPLY}$ is not in transition between two different supply voltages based on a change in operating mode), common-mode voltage generator 20 generates such desired output common-mode voltage $V_{CM_D}$ in accordance with a second bandwidth, wherein the second bandwidth defines a speed of response of desired output common-mode voltage $V_{CM_D}$ to changes in power supply voltage $V_{SUPPLY}$. Such second bandwidth may be related to a bandwidth of a filter internal to common-mode voltage generator 20 intended to filter out momentary changes in $V_{SUPPLY}$ (e.g., undesired voltage spikes due to noise on the supply) so that desired output common-mode voltage $V_{CM_D}$ does not respond to such momentary changes. For example, in some embodiments, common-mode voltage generator 20 may comprise a high-power supply rejection ratio common-mode voltage generator.

A common-mode feedback loop 22 may set the actual common-mode voltage $V_{CM_A}$ at each of a pair of differential output terminals of amplifier A1 based on a calculated error between desired output common-mode voltage $V_{CM_D}$ and a measurement of common-mode voltage $V_{CM_A}$ based on differential audio output signal $V_{OUT}$. In steady-state operation (e.g., when power supply voltage $V_{SUPPLY}$ is not in transition between two different supply voltages based on a change in operating mode), common-mode feedback loop 22 sets actual common-mode voltage $V_{CM_A}$ in accordance with a third bandwidth, wherein the third bandwidth defines a speed of response of actual common-mode voltage $V_{CM_A}$ to changes in desired output common-mode voltage $V_{CM_D}$. Such third bandwidth may be related to a bandwidth of a common-mode amplifier or common-mode feedback circuitry of common-mode feedback loop 22 intended to optimize the performance of the audio output stage and minimize power consumption.

In steady-state operation (e.g., when power supply voltage $V_{SUPPLY}$ is not in transition between two different supply voltages based on a change in operating mode), the third bandwidth (of common-mode feedback loop 22) may be lesser than the second bandwidth (of common-mode voltage generator 20), which is in turn may be lesser than the first bandwidth (of power supply 10). Thus, if power supply 10, in response to a change in its operating mode from one mode to another, drastically changes power supply voltage $V_{SUPPLY}$, common-mode voltage generator 20 and common-mode feedback loop 22 would be slow to respond to the change in power supply voltage $V_{SUPPLY}$ if they continued to operate in accordance with their steady-state operation, thus potentially causing clipping or other distortion of the audio output signal.

Accordingly, audio integrated circuit 9 may include a common-mode voltage control circuit 24 configured to determine if power supply voltage $V_{SUPPLY}$ is in transition between two voltage levels as a result of power supply 10 changing between operating modes and outputting a signal TRANSITION indicating whether such a transition is presently occurring. For example, common-mode voltage control circuit 24 may include a comparator that compares the MODE SELECT signal generated by mode control circuit 12 to power supply voltage $V_{SUPPLY}$ to determine if power supply voltage $V_{SUPPLY}$ is at or near the intended power supply voltage level dictated by MODE SELECT signal. Common-mode voltage control circuit 24 may communicate signal TRANSITION indicative of whether a power supply voltage is presently occurring to one or more of power supply 10, common-mode voltage generator 20, and common-mode feedback loop 22 such that responsive to a transition of the power supply voltage due to a change between two operating modes of power supply 10, common-mode voltage control circuit 24 modifies at least one of the first bandwidth, the second bandwidth, and the third bandwidth such that the second bandwidth is greater than or substantially equal to the first bandwidth during the transition and the third bandwidth is greater than or substantially equal to the second bandwidth during the transition.

In some embodiments, each of one or more of common-mode voltage generator 20 and common-mode feedback loop 22 may have at least two modes of operation comprising a first mode and a second mode wherein each mode corresponds to an associated bandwidth, and wherein modifying at least one of the first bandwidth, the second bandwidth, and the third bandwidth during a transition of power supply voltage $V_{SUPPLY}$ comprises switching one or more of common-mode voltage generator 20 and common-mode feedback loop 22 between the first mode and the second mode. For example, with respect to common-mode voltage generator 20, the second bandwidth may be increased by increasing a speed or bandwidth of a filter internal to common-mode voltage generator 20. As another example, with respect to common-mode feedback loop 22, the second bandwidth may be increased by increasing power consumption or introducing a bandwidth-enhancing snubber circuit internal to common-mode feedback loop 22.

Figure 3A:
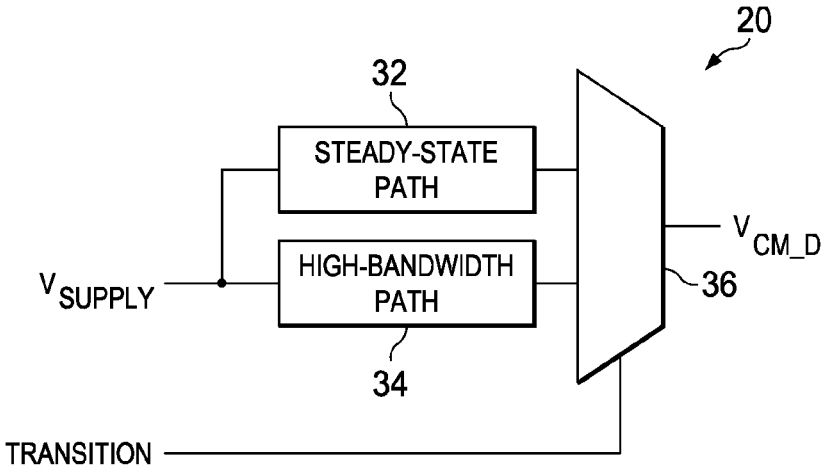
FIG. 3A is a block diagram of selected components of an example common-mode voltage generator, in accordance with embodiments of the present disclosure.

In other embodiments, the second bandwidth may be increased by bypassing the steady-state elements of common-mode voltage generator 20 with an alternative path having a higher bandwidth, as shown in FIG. 3A. FIG. 3A is a block diagram of selected components of an example common-mode voltage generator 20, in accordance with embodiments of the present disclosure. As shown in FIG. 3A, common-mode voltage generator 20 may receive power supply voltage $V_{SUPPLY}$ and the signal TRANSITION and apply power supply voltage $V_{SUPPLY}$ to both a steady-state path 32 and a high-bandwidth path 34. A multiplexer 36 may select between the outputs of steady-state path 32 and high-bandwidth path 34 based on signal TRANSITION to generate desired output common-mode voltage $V_{CM_D}$. In some embodiments, high-bandwidth path 34 may comprise a simple, low-delay and high-bandwidth circuit (e.g., a resistive voltage divider), such that the second bandwidth is substantially equal to the first bandwidth.

Figure 3B:
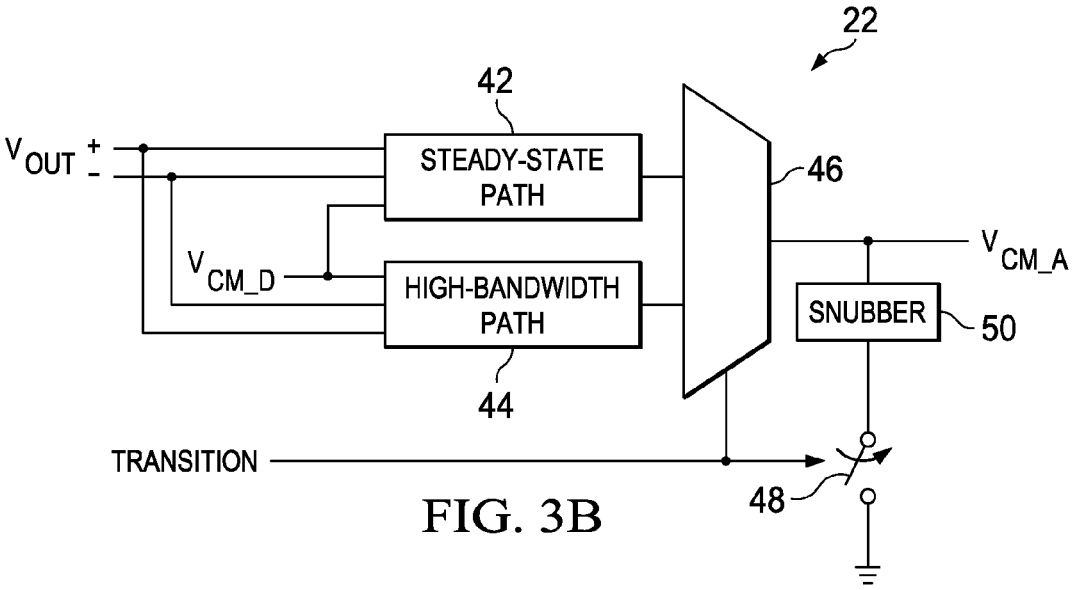
FIG. 3B is a block diagram of selected components of an example common-mode feedback loop, in accordance with embodiments of the present disclosure.

In other embodiments, the third bandwidth may be increased by bypassing the steady-state elements of common-mode feedback loop 22 with an alternative path having a higher bandwidth, as shown in FIG. 3B. FIG. 3B is a block diagram of selected components of an example common-mode feedback loop 22, in accordance with embodiments of the present disclosure. As shown in FIG. 3B, common-mode feedback loop 22 may receive desired output common-mode voltage $V_{CM_D}$, differential audio output signal $V_{OUT}$, and the signal TRANSITION and apply desired output common-mode voltage $V_{CM_D}$ to both a steady-state path 42 (along with differential audio output signal $V_{OUT}$) and a high-bandwidth path 44. A multiplexer 46 may select between the outputs of steady-state path 42 and high-bandwidth path 44 based on signal TRANSITION to set actual common-mode voltage $V_{CM_A}$. In some embodiments, common-mode feedback loop 22 may comprise a bandwidth-enhancing snubber circuit 50 which is enabled by switch 48 when the signal TRANSITION is asserted, such that the third bandwidth is substantially equal to the second bandwidth.

This disclosure encompasses all changes, substitutions, variations, alterations, and modifications to the exemplary embodiments herein that a person having ordinary skill in the art would comprehend. Similarly, where appropriate, the appended claims encompass all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An audio amplifier circuit for providing a differential output signal to an audio transducer, the audio amplifier circuit comprising:

a power amplifier having an audio input for receiving a differential audio input signal, an audio output having a pair of differential output terminals for providing the differential output signal based on the differential audio input signal, and a power supply input;

a power supply for providing a power supply voltage to the power supply input, wherein the power supply has a selectable operating mode selectable among a plurality of modes including at least a first operating mode and a second operating mode, wherein the power supply voltage is of a first magnitude in the first operating mode and is of a second magnitude in the second operating mode, and wherein the power supply voltage transitions between magnitudes associated with the plurality of modes in accordance with a first bandwidth;

a common-mode voltage generator for generating a desired output common-mode voltage based on the power supply voltage, wherein the desired output common-mode voltage responds to the power supply voltage in accordance with a second bandwidth;

a common-mode feedback loop for setting an actual common-mode voltage at each of the pair of differential output terminals based on the desired output common-mode voltage, wherein the actual common-mode voltage responds to the desired common-mode voltage in accordance with a third bandwidth; and a control circuit for, responsive to a transition of the power supply voltage due to a change between two of the plurality of modes, modifying at least one of the first bandwidth, the second bandwidth, and the third bandwidth such that the second bandwidth is greater than or substantially equal to the first bandwidth during the transition and the third bandwidth is greater than or substantially equal to the second bandwidth during the transition.

2. The audio amplifier circuit of claim 1, wherein the power supply voltage is a single-ended voltage referenced to a ground voltage.

3. The audio amplifier circuit of claim 1, wherein the power supply voltage is a differential voltage.

4. The audio amplifier circuit of claim 1, wherein modifying at least one of the first bandwidth and the second bandwidth such that the second bandwidth is greater than or substantially equal to the first bandwidth during the transition comprises increasing the second bandwidth to be greater than the first bandwidth during the transition.

5. The audio amplifier circuit of claim 1, wherein modifying at least one of the second bandwidth and the third bandwidth such that the third bandwidth is greater than or substantially equal to the second bandwidth during the transition comprises increasing the third bandwidth to be greater than the second bandwidth during the transition.

6. The audio amplifier circuit of claim 1, wherein the common-mode voltage generator has at least two modes of operation comprising a first mode and a second mode and each mode corresponds to an associated bandwidth, and wherein modifying at least one of the first bandwidth and the second bandwidth such that the second bandwidth is greater than or substantially equal to the first bandwidth during the transition comprises switching the common-mode voltage generator from the first mode to the second mode.

7. The audio amplifier circuit of claim 1, wherein the common-mode feedback loop has at least two modes of operation comprising a first mode and a second mode and each mode corresponds to an associated bandwidth, and wherein modifying at least one of the second bandwidth and the third bandwidth such that the third bandwidth is greater than or substantially equal to the second bandwidth during the transition comprises switching the common-mode feedback loop from the first mode to the second mode.

8. A method for providing a differential output signal to an audio transducer, the method comprising:

responsive to a transition of a power supply voltage generated by a power supply for providing the power supply voltage to a power supply input of a power amplifier having an audio input for receiving a differential audio input signal, and an audio output having a pair of differential output terminals for providing the differential output signal based on the differential audio input signal, modifying at least one of:

a first bandwidth associated with the power supply, wherein the power supply has a selectable operating mode selectable among a plurality of modes including at least a first operating mode and a second operating mode, wherein the power supply voltage is of a first magnitude in the first operating mode and is of a second magnitude in the second operating mode, and wherein the power supply voltage transitions between magnitudes associated with the plurality of modes in accordance with the first bandwidth;

a second bandwidth associated with a common-mode voltage generator for generating a desired output common-mode voltage based on the power supply voltage, wherein the desired output common-mode voltage responds to the power supply voltage in accordance with the second bandwidth; and a third bandwidth associated with a common-mode feedback loop for setting an actual common-mode voltage at each of the pair of differential output terminals based on the desired output common-mode voltage, wherein the actual common-mode voltage responds to the desired common-mode voltage in accordance with the third bandwidth;

such that the second bandwidth is greater than or substantially equal to the first bandwidth during the transition and the third bandwidth is greater than or substantially equal to the second bandwidth during the transition.

9. The method of claim 8, wherein the power supply voltage is a single-ended voltage referenced to a ground voltage.

10. The method of claim 8, wherein the power supply voltage is a differential voltage.

11. The method of claim 8, wherein modifying at least one of the first bandwidth and the second bandwidth such that the second bandwidth is greater than or substantially equal to the first bandwidth during the transition comprises increasing the second bandwidth to be greater than the first bandwidth during the transition.

12. The method of claim 8, wherein modifying at least one of the second bandwidth and the third bandwidth such that the third bandwidth is greater than or substantially equal to the second bandwidth during the transition comprises increasing the third bandwidth to be greater than the second bandwidth during the transition.

13. The method of claim 8, wherein the common-mode voltage generator has at least two modes of operation comprising a first mode and a second mode and each mode corresponds to an associated bandwidth, and wherein modifying at least one of the first bandwidth and the second bandwidth such that the second bandwidth is greater than or substantially equal to the first bandwidth during the transition comprises switching the common-mode voltage generator from the first mode to the second mode.

14. The method of claim 8, wherein the common-mode feedback loop has at least two modes of operation comprising a first mode and a second mode and each mode corresponds to an associated bandwidth, and wherein modifying at least one of the second bandwidth and the third bandwidth such that the third bandwidth is greater than or substantially equal to the second bandwidth during the transition comprises switching the common-mode feedback loop from the first mode to the second mode.

15. A control circuit comprising:

circuitry configured to:

responsive to a transition of a power supply voltage generated by a power supply for providing the power supply voltage to a power supply input of a power amplifier having an audio input for receiving a differential audio input signal, and an audio output having a pair of differential output terminals for providing the differential output signal based on the differential audio input signal, modify at least one of:

a first bandwidth associated with the power supply, wherein the power supply has a selectable operating mode selectable among a plurality of modes including at least a first operating mode and a second operating mode, wherein the power supply voltage is of a first magnitude in the first operating mode and is of a second magnitude in the second operating mode, and wherein the power supply voltage transitions between magnitudes associated with the plurality of modes in accordance with the first bandwidth;

a second bandwidth associated with a common-mode voltage generator for generating a desired output common-mode voltage based on the power supply voltage, wherein the desired output common-mode voltage responds to the power supply voltage in accordance with the second bandwidth; and a third bandwidth associated with a common-mode feedback loop for setting an actual common-mode voltage at each of the pair of differential output terminals based on the desired output common-mode voltage, wherein the actual common-mode voltage responds to the desired common-mode voltage in accordance with the third bandwidth;

such that the second bandwidth is greater than or substantially equal to the first bandwidth during the transition and the third bandwidth is greater than or substantially equal to the second bandwidth during the transition.

16. The control circuit of claim 15, wherein the power supply voltage is a single-ended voltage referenced to a ground voltage.

17. The control circuit of claim 15, wherein the power supply voltage is a differential voltage.

18. The control circuit of claim 15, wherein modifying at least one of the first bandwidth and the second bandwidth such that the second bandwidth is greater than or substantially equal to the first bandwidth during the transition comprises increasing the second bandwidth to be greater than the first bandwidth during the transition.

19. The control circuit of claim 15, wherein modifying at least one of the second bandwidth and the third bandwidth such that the third bandwidth is greater than or substantially equal to the second bandwidth during the transition comprises increasing the third bandwidth to be greater than the second bandwidth during the transition.

20. The control circuit of claim 15, wherein the common-mode voltage generator has at least two modes of operation comprising a first mode and a second mode and each mode corresponds to an associated bandwidth, and wherein modifying at least one of the first bandwidth and the second bandwidth such that the second bandwidth is greater than or substantially equal to the first bandwidth during the transition comprises switching the common-mode voltage generator from the first mode to the second mode.

21. The control circuit of claim 15, wherein the common-mode feedback loop has at least two modes of operation comprising a first mode and a second mode and each mode corresponds to an associated bandwidth, and wherein modifying at least one of the second bandwidth and the third bandwidth such that the third bandwidth is greater than or substantially equal to the second bandwidth during the transition comprises switching the common-mode feedback loop from the first mode to the second mode.

* * * * *